US006826861B2

(12) United States Patent
Alexander et al.

(10) Patent No.: US 6,826,861 B2
(45) Date of Patent: Dec. 7, 2004

(54) TEMPORARY SIGN SYSTEM

(76) Inventors: Luther Kenneth Alexander, 9434 Arvin Hill Rd., Aubrey, TX (US) 76227; Ricky T. Holder, 115 Hughes St., Seneca, SC (US) 29672; Lamar Merck, 257 Powder Mill Rd., Central, SC (US) 29630-9542

( * ) Notice: Subject to any disclaimer, the term of this patent is extended or adjusted under 35 U.S.C. 154(b) by 39 days.

(21) Appl. No.: 09/817,779

(22) Filed: Mar. 26, 2001

(65) Prior Publication Data

US 2002/0133989 A1 Sep. 26, 2002

(Under 37 CFR 1.47)

(51) Int. Cl.[7] ..... G09F 7/00
(52) U.S. Cl. ..... 40/601; 40/603
(58) Field of Search ..... 40/606.01, 601, 40/603

(56) References Cited

U.S. PATENT DOCUMENTS

| | | | | | |
|---|---|---|---|---|---|
| 884,951 | A | | 4/1908 | Perry | |
| 965,097 | A | * | 7/1910 | Fisher | 40/603 |
| 1,601,220 | A | | 9/1926 | Leu et al. | |
| 1,751,614 | A | * | 3/1930 | Born | 40/603 |
| 2,125,994 | A | * | 8/1938 | Doering | 40/601 X |
| 2,591,494 | A | | 4/1952 | Asachika | |
| 3,938,269 | A | | 2/1976 | Catteau | |
| 4,700,498 | A | * | 10/1987 | Perutz et al. | 40/603 |
| 4,906,503 | A | * | 3/1990 | De La Cruz et al. | 40/603 X |
| 5,142,804 | A | | 9/1992 | Hillstrom et al. | |
| 5,244,302 | A | * | 9/1993 | Ollivier | 40/606 X |
| 5,471,775 | A | | 12/1995 | Hoyt et al. | |
| 5,941,001 | A | | 8/1999 | Dietrich et al. | |
| 6,055,754 | A | * | 5/2000 | Melhuus | 40/601 |

FOREIGN PATENT DOCUMENTS

| | | | | |
|---|---|---|---|---|
| BE | 529802 | * | 7/1954 | 40/603 |
| GB | 2142459 | * | 1/1985 | 40/603 |

* cited by examiner

*Primary Examiner*—Joanne Silbermann
(74) *Attorney, Agent, or Firm*—Dority & Manning, P.A.

(57) ABSTRACT

A sign system that is suitable for temporary use. A plurality of frame assemblies are provided which are secured at a desired site. A banner bearing a predetermined image to be displayed is securable to a number of frame assemblies and is erectable to a display position with respect to the frame assemblies. The system may be secured at an outside or inside site for temporary use for an event.

7 Claims, 6 Drawing Sheets

TEMPORARY SIGN SYSTEM

FIELD OF THE INVENTION

The present invention relates to signage in general and in particular to large signs for temporary installation at sporting events, trade shows, expositions, retail establishments, and the like.

BACKGROUND OF THE INVENTION

There are vast and sundry types of signs in existence today that are utilized to advertise particular products, to alert one to an upcoming or ongoing event, and the like. Such signs typically are permanently mounted to a building, to the ground, or the like without any intention that they be removed. By way of example billboards have been affixed to permanent wooden structures that are secured to the ground along highways, or attached to a steel superstructure also that is permanently attached to the ground along a highway or the like. With such signs, the particular signage employed is typically changed by reprinting the signage in strips and then re-pasting or otherwise adhesively securing the strips to form a mosaic that depicts the desired image.

Likewise certain small signs are employed such as by way of example in advance of highway construction to alert oncoming traffic of the existence of the construction site, and may or may not include directional indicators. Signs of this type are typically mounted on a trailer or vehicle or on a pedestal that simply rests atop the surface of the ground.

Signs exist in the prior art where the supports for the sign are permanently installed and where the signage may be manipulated when not in use to reduce resistance to wind and therefore require less structural integrity of the support for the sign.

Temporary signs for the most part are intended for one time use and include legs with pointed tips which are forced into the ground. A paperboard printed sign or banner is then stapled, nailed or tied to the legs. Such signs frequently are seen preceding elections.

Known patented prior art relevant to the present invention includes the following: U.S. Pat. No. 2,591,494 to Asachika; U.S. Pat. No. 3,938,269 to Catteau; U.S. Pat. No. 5,941,001 to Dietrich et al.; U.S. Pat. No. 5,471,775 to Hoyt et al.; U.S. Pat. No. 5,142,804 to Hillstrom et al.; U.S. Pat. No. 977,862 to Grant; U.S. Pat. No. 884,951 to Perry; and U.S. Pat. No. 1,601,220 to Leu et al.

None of the above prior art is believed to teach or suggest the temporary sign structure according to the present invention.

SUMMARY OF THE INVENTION

The present invention is directed to a temporary sign that may be easily erected and taken down at temporary locations and for use for limited periods of time. The sign can be erected for display on virtually any support surface where location of the sign is needed. Signs according to the present invention permit ease of installation and removal, ease of transport and ease of replacement of the display.

It is thus an object of the present invention to provide an improved, temporary sign system for use in outdoor or indoor environs.

Another object of the present invention is to provide an improved temporary sign that is simple, structurally sufficient for the environs, and may be quickly erected and left standing in place for a predetermined period of time.

Still further another object of the present invention is to provide an improved temporary sign that can be erected for a short period of time during which a particular event takes place, and without significant site improvement.

Yet further, another object of the present invention is to provide a temporary sign system that is modular, is easy to erect and disassemble, and may be conveniently stored or transported.

Still another object of the present invention is to provide a sign system that permits ease of change of the image display.

DESCRIPTION OF PREFERRED EMBODIMENTS

Figure 1:
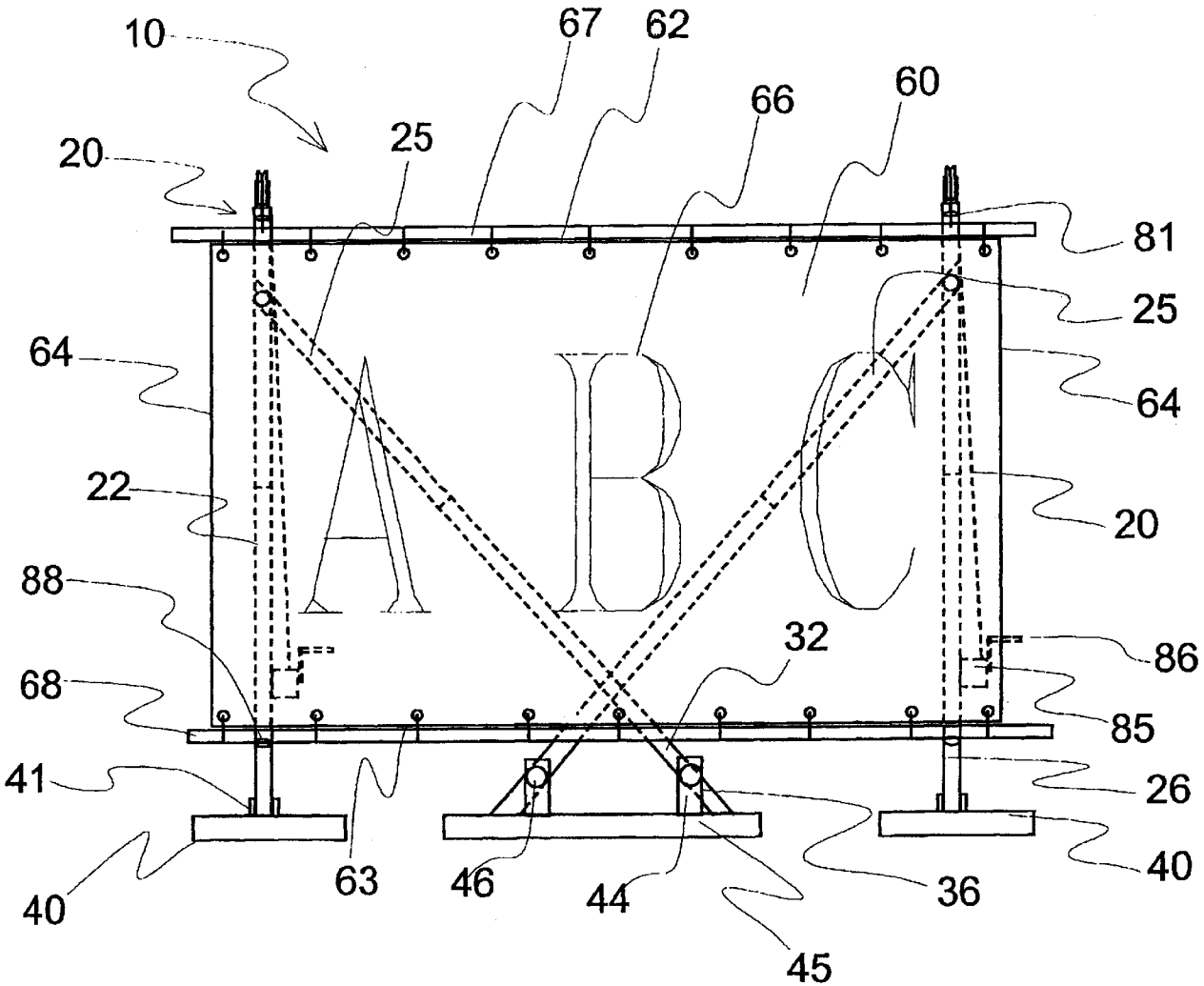
FIG. 1 is a frontal elevational view of one embodiment of a sign system according to teachings of the present invention.
Figure 2:
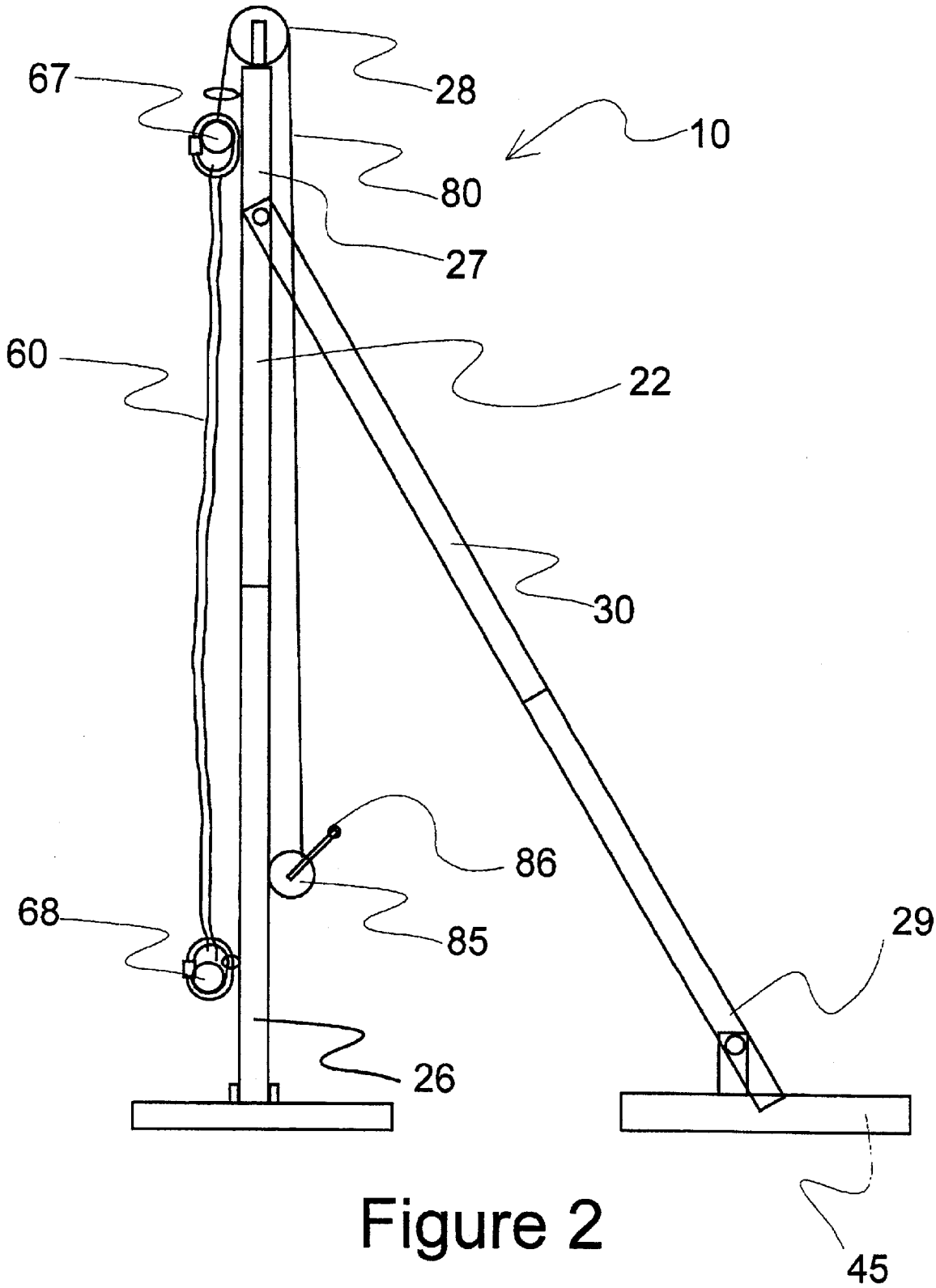
FIG. 2 is a side elevational view of the sign system as depicted in FIG. 1.

Making reference to the Figures, preferred embodiments of the present invention will now be described in detail. FIGS. 1 and 2 illustrate one embodiment of a sign system according to the present invention, generally illustrated as 10. FIG. 1 shows such a sign system 10 which illustrates a single panel for image display. It is within the purview of the present invention that the size of the structure can be varied both as to panel size and as to the number of panels that are utilized as well as the framework therefor. Sign system 10 includes a display panel or banner 60 for a predetermined image display as at 66 that is removably secured to a support frame made up of a plurality of frame assemblies generally 20. Each frame assembly 20 includes structural elements necessary for strength to withstand the environs in which it is placed. FIG. 1 illustrates one embodiment for outdoor use, such location at an automobile racetrack.

Figure 6:
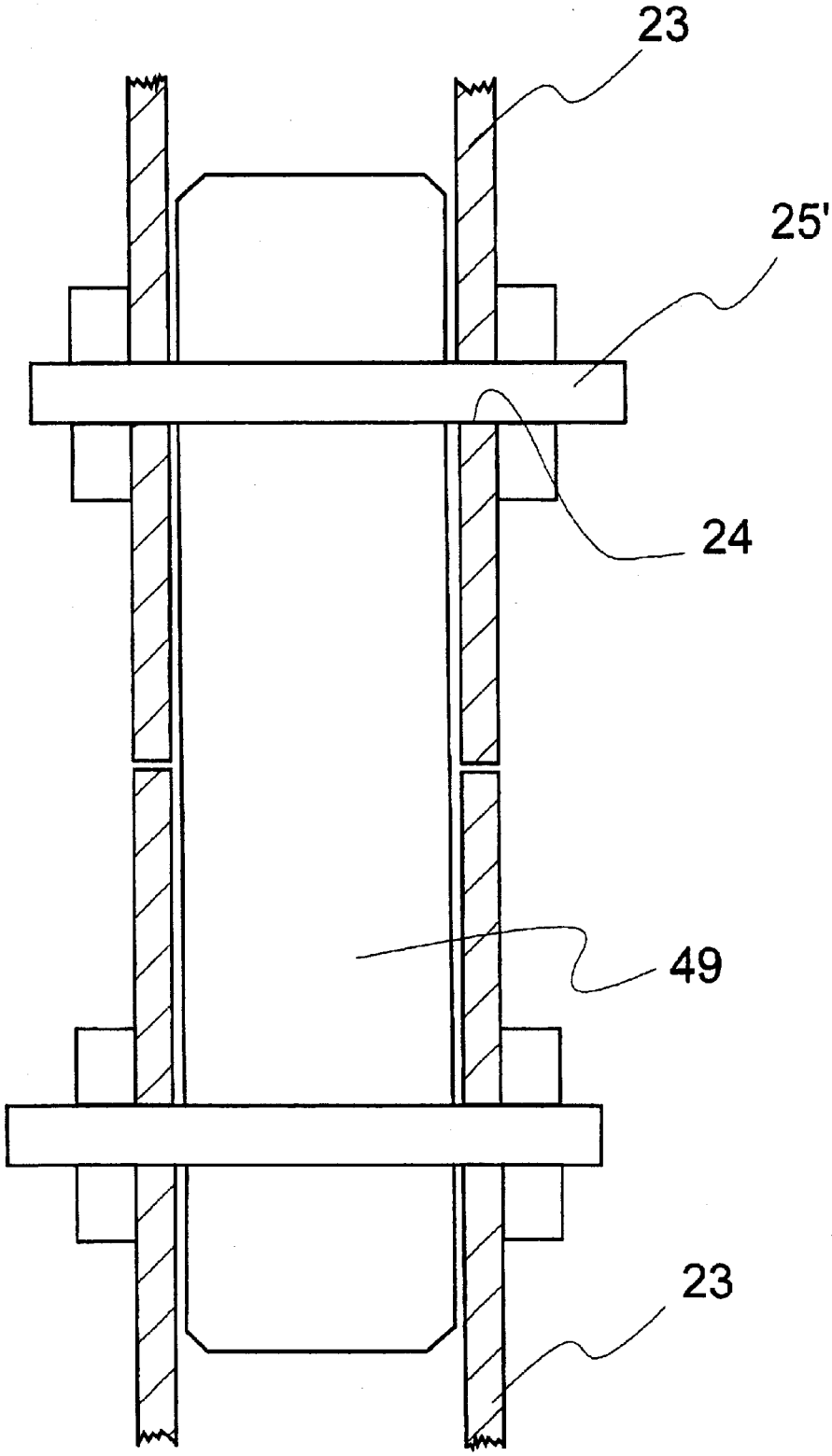
FIG. 6 is a partial cross sectional view of an embodiment of a vertical support post of a frame assembly showing an embodiment of union of the post sections.

The frame assemblies 20 shown in FIGS. 1 and 2 include a vertical support post 22, preferably tubular in construction with a lower end 26 adapted for securement at the site and an upper end that receives a pulley wheel or the like 28, the purpose of which will be described hereinafter. Frame assembly 20 further includes adequate additional supports to supply needed strength for the environs. FIG. 2 for an outdoor environment includes a rearward support strut 30 secured at one end to post 22 intermediate its length, and adapted at a lower end 29 for securement at the site. A lateral support or brace 25 is also provided which is secured at one end to post 22 and at an opposite end 32 is adapted for securement at the site. As illustrated in FIG. 1 lateral supports 25 for adjacent frame assemblies 20 may cross, and may be secured to each other at the point of intersection. Like post 22, supports 25 may also be tubular, and for ease of handling and transport may be made up of a plurality of sections. See FIG. 6 for example, which illustrates one embodiment of suitable tubular connection for a post 22 or supports 25 and 30. Sections 23 are illustrated with a connector 49 that telescopes into ends of adjacent sections 23. Openings 24 are provided through sections 23 and connector 49. Pins, cotter keys, bolts, or the like 24' may pass through openings 24 and secure sections 23 to form post 22. Likewise lockable hinge connections (not shown) could be made between adjacent post sections 23 to permit collapse of post 22 for storage and transport.

Figure 4:
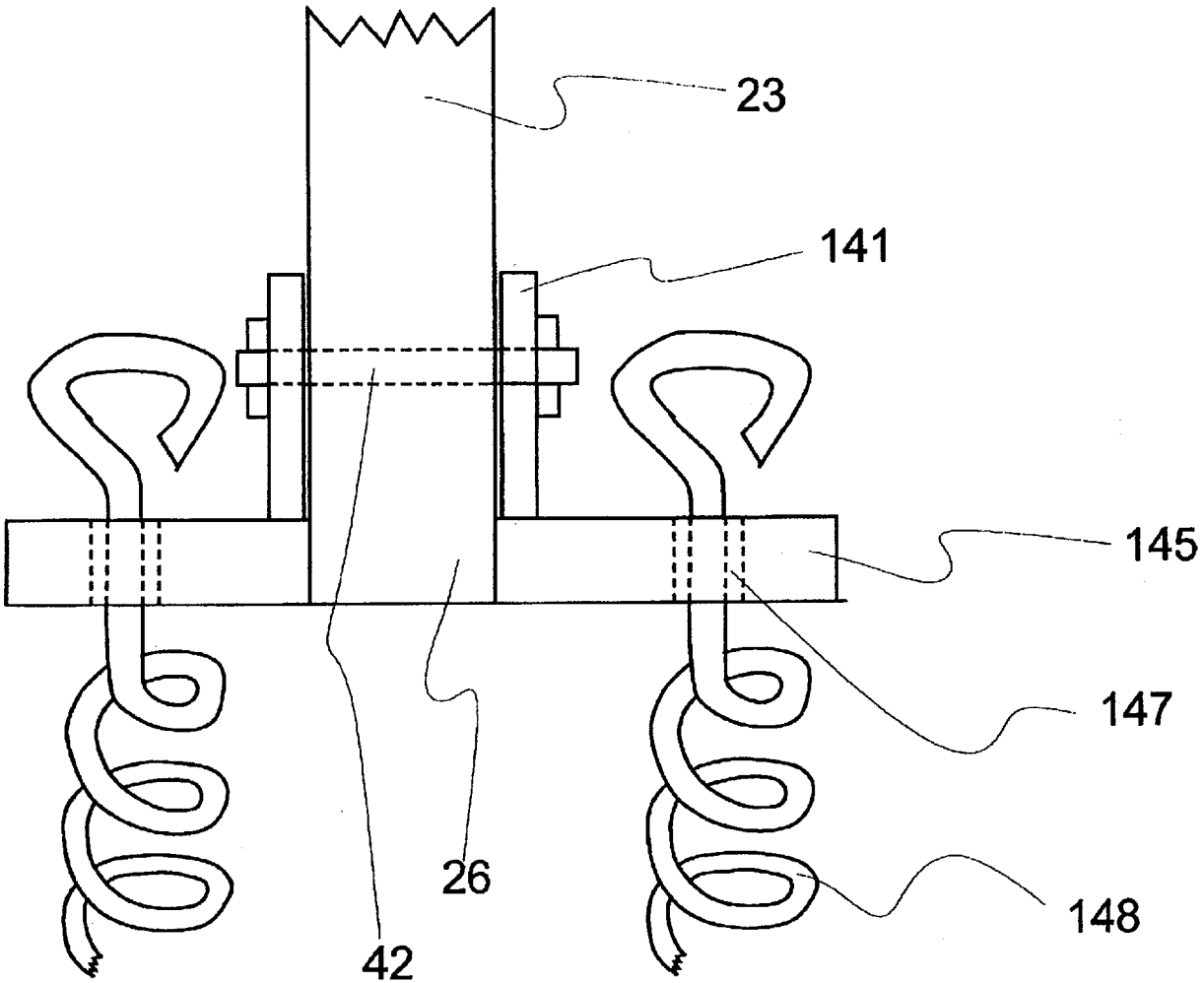
FIG. 4 and FIG. 5 illustrate embodiments of temporary securement techniques for sign systems according to the present invention.
Figure 5:
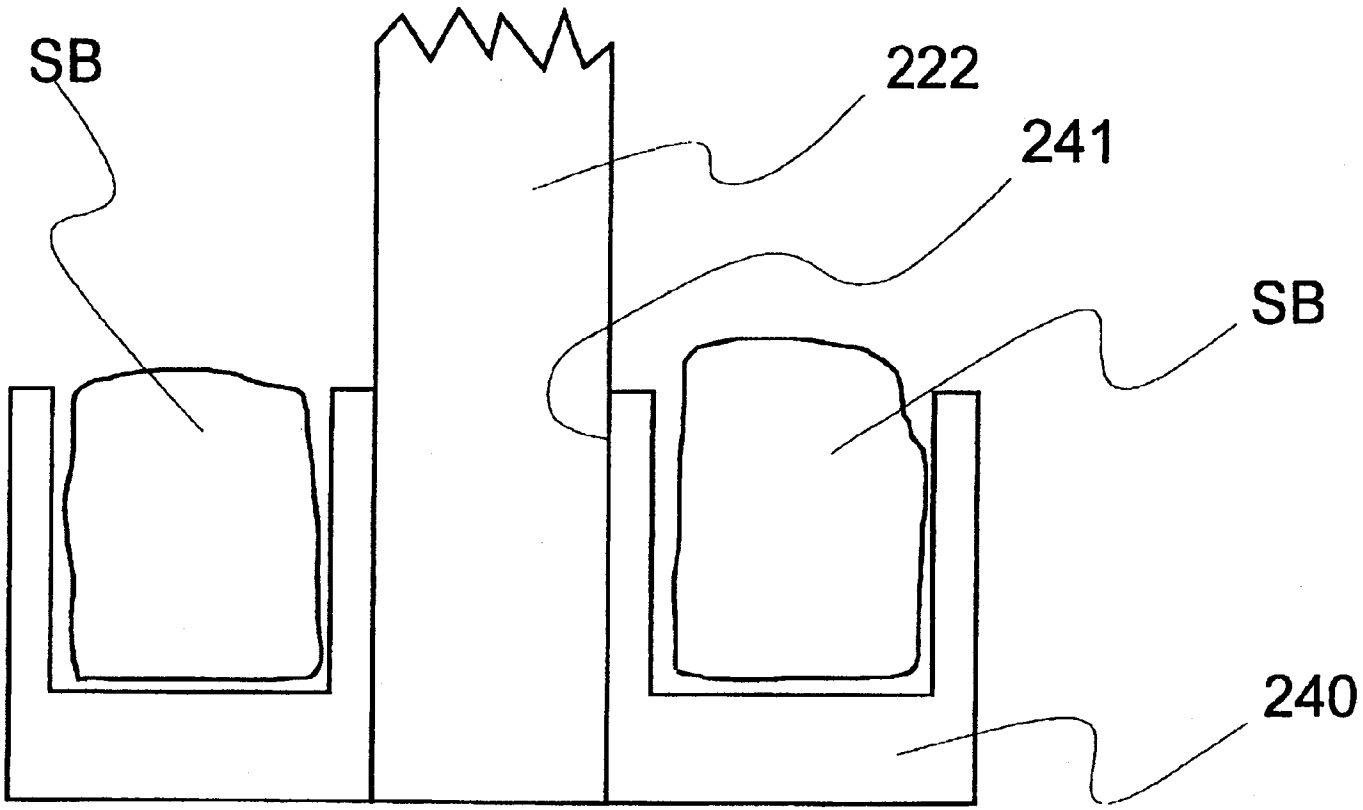

Securement at the site for the embodiment of FIG. 1 is illustrated by a plurality of base pads 40, 45 which receive the lower ends of posts 22 and supports 25 and 30 respectively. Base pads 40 include an upstanding tubular receiver 41 into which end 26 of post 22 may be received and secured by pins or the like such as for example the type shown in FIG. 6. Base pads 45 have an upstanding element 44 to which ends 29 and 32 of supports 30 and 25 respectively may be secured by bolts or the like 46. Sand bags, SB (See FIG. 5) or other weighted objects may then be placed atop base pads 40, 45 to secure frame assemblies 20 in place. However, as shown in FIG. 4, a preferred securement of frame assemblies 20 at site is illustrated and includes base pads 145 with one or more openings 147 through which augers 148, stakes or the like may pass and be embedded in the ground to secure base pad 145 and therefore frame assemblies 20 to the ground. FIG. 5 shows yet another embodiment in which base pad 240 is a toroidal container defining an opening 241 there through for receipt of post 222. Base pads (not shown) may also be utilized which are hollow and are filled with water, sand or the like for securement of assemblies 20.

Figure 3:
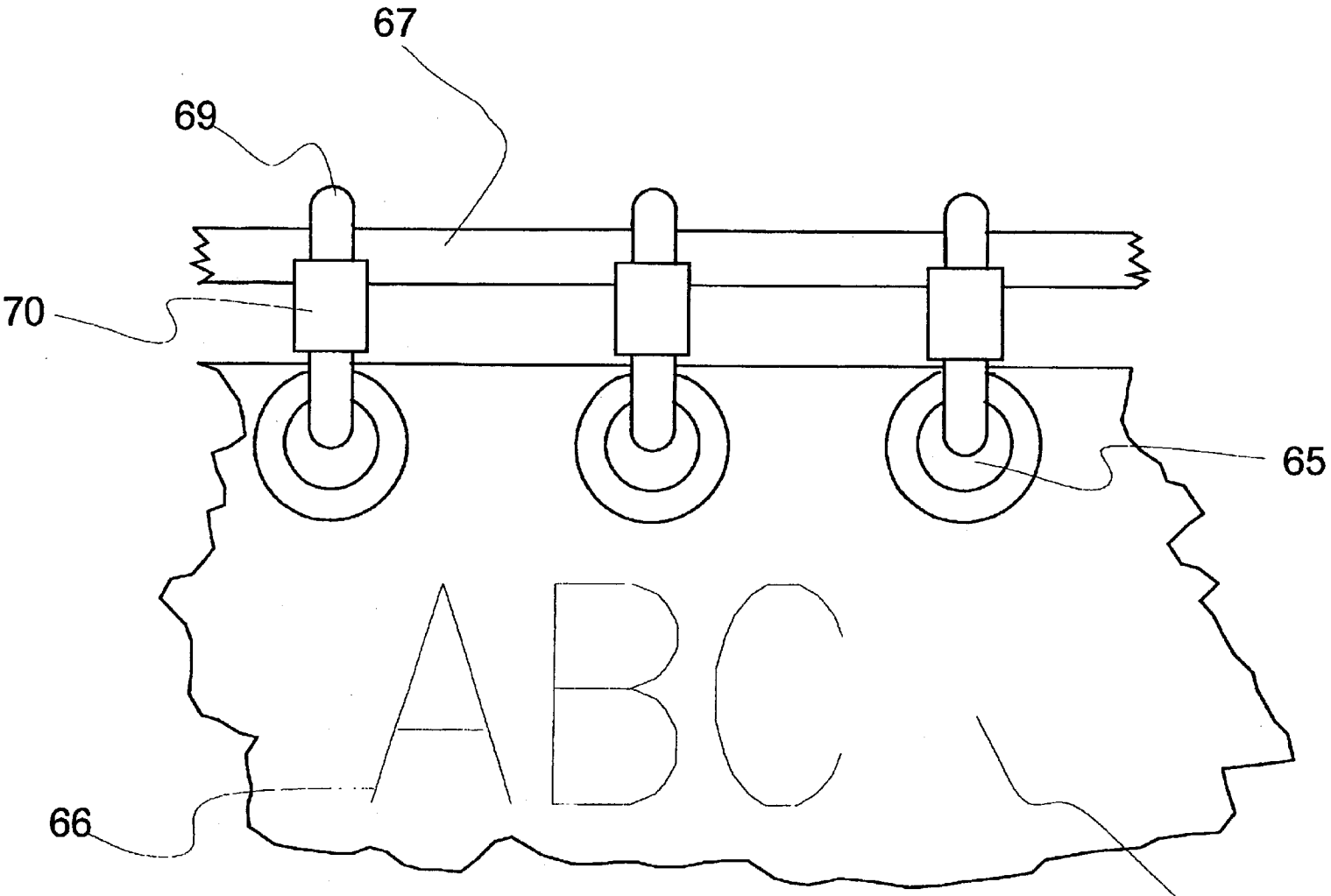
FIG. 3 is a partial frontal view of a sign according to the present invention illustrating particulars of the image display.

Banner 60 can, as noted above, be any size and may be adorned as desired with an image 66 to be displayed. Banner 60 as shown in FIGS. 1 and 3 may include a fabric, polymeric film or the like that is flexible and may or may not be reinforced about its periphery. Banner 60 is rectangular as shown with upper and lower edges 62, 63 and side edges 64. A plurality of openings 65 are provided along upper and lower edges 62, 63 to permit securement of banner 60 to upper and lower banner rods 67, 68 such as by way of known rings 69 that have a screw closure 70. However there are other suitable connectors that will pass through openings 65 and around rods 67, 68 that are then closeable to removably secure banner 60 to rods 67, 68 including without limitation polymeric strips with a locking housing through which a tip of the strip may pass in a locking direction only, rings, twine, or the like. Preferably the securement means between banner 60 and rods 67, 68 are removable to permit reuse of rods 67, 68 with different banners.

An elongated flexible element 80 such as a cable, rope, wire or the like is secured to upper rod 67, preferably in line with each post 22, and extends upwardly along post 22, over pulley wheel 28 and down an opposite side of post 22 where an end of the element is secured to post 22. Preferably a ratcheting winch 85 is secured to a side of post 22 opposite banner 60 with an end of element 80 secured to winch 85. Lower banner rod 68 is secured to post 22 as at 88 which may be clamps, or any mechanism that will removably secure the bottom end of banner 60 to posts 22. With such an arrangement, turning of winch 85 as by handle 86 will lift banner 60 to its display position while the ratchet arrangement of winch 85 holds elongated element 80 taut. Winch 85 is a standard item of commerce and is not described further herein.

With the embodiments described above a desired number of frame assemblies 20 may be secured to the ground or other surface as dictated by the size of banner 60, and with a minimum of two frame assemblies 20. Banner 60 can then be added to the frame assemblies and pulled open to display the image 66. Further, since the frame assemblies need not be structurally joined to each other to form a rigidified structure, differences in topography can be tolerated without any significant site preparation.

Further, for indoor use, securement of the frame assemblies is not nearly so critical as on the outside since wind is not a factor. Accordingly, frame assemblies 20 may simply use base pads with adequate size to enable the sign system to stand erect in a stable fashion.

The various features described above for a sign system according to the present invention may be utilized in any desired combination. Further, It is to be understood that the present invention is not limited to the embodiments described above, but encompasses any and all embodiments within the scope of the following claims.

What is claimed is:

1. A portable sign for temporary site location, comprising:

a plurality of frame assemblies, each said frame assembly including a plurality of spaced apart, generally parallel vertical support posts, said vertical support posts having a top end and a bottom end, said bottom end being removably locatable at a support surface for erection of said sign, each said vertical support post having one or more rearward support strut and one or more lateral brace, one end of each said rearward support strut and said lateral brace being securable to said vertical support post at a location along the length of said vertical support post and an opposite end of said rearward support strut and said lateral brace being removably locatable at a support surface to allow lateral support for said vertical support post;

a flexible banner, displaying predetermined indicia, being locatable in front of at least certain of said vertical support posts, said banner having outer peripheral edges;

means to secure a bottom peripheral edge of said banner to at least certain of said vertical support posts;

a member attached to the a top peripheral edge of said banner;

a winding drum being attached to at least certain of said vertical support posts;

a pulley wheel attached to the said top end of at least certain of said vertical support posts;

a plurality of elongated flexible elements, each said flexible element being secured at one end to said member and being passable over one of said pulley wheels on one of said vertical posts, and being secured at the opposite end to said winding drum for winding thereupon;

means for securing said frame assemblies to a support surface at said site.

2. A portable sign system for temporary site location as in claim 1, wherein said vertical posts, said support struts, and said lateral braces comprise a plurality of sections.

3. A portable sign system for temporary site location as in claim 1, wherein said banner is a polymeric film.

4. A portable sign system for temporary site location as in claim 1, wherein said banner is a fabric.

5. A portable sign system for temporary site location as in claim 1, further comprising base pads for receipt of said bottom end of said vertical support post and base pads for receipt of said opposite end of said rearward support strut and said opposite end of said of said lateral brace.

6. A portable sign system for temporary site location as in claim 5, further comprising means for securing said base pads to said site.

7. A portable sign system for temporary site location as in claim 5, further comprising weighted elements for securing said base pads to site.

* * * * *